United States Patent [19]

Ishii

[11] Patent Number: 5,007,338

[45] Date of Patent: Apr. 16, 1991

[54] IMAGE POSITION ADJUSTING DEVICE IN PRINTING MACHINE

[75] Inventor: Koji Ishii, Fuchu, Japan

[73] Assignee: Ryobi Ltd., Hiroshima, Japan

[21] Appl. No.: 377,996

[22] Filed: Jul. 11, 1989

[30] Foreign Application Priority Data

Jul. 14, 1988 [JP] Japan ..... 63-176279

[51] Int. Cl.[5] ..... B41F 5/22; B41F 13/14

[52] U.S. Cl. ..... 101/142; 101/248

[58] Field of Search ..... 101/248, 216, 177, 217, 101/216, 232, 181, 137, 142, 144; 74/396, 397

[56] References Cited

U.S. PATENT DOCUMENTS

| | | | |
|---|---|---|---|
| 2,301,379 | 11/1942 | Davis | 101/248 |
| 3,390,632 | 7/1968 | Jahme | 101/248 |
| 3,413,920 | 12/1968 | Kaneko et al. | 101/248 |
| 3,884,146 | 5/1975 | Ruetschle | 101/248 |
| 4,029,009 | 6/1977 | Kühn et al. | 101/232 X |

*Primary Examiner*—J. Reed Fisher

*Attorney, Agent, or Firm*—Sughrue, Mion, Zinn, Macpeak & Seas

[57] ABSTRACT

An image position adjusting device for controlling an imaging area in a longitudinal direction of a printing sheet. This position control is made by rotating one of the impression and blanket cylinders with respect to the other. A first intermediate gear is mounted on a shaft extending between the side frames of the printing machine, and a second intermediate gear is engaged with the first intermediate gear and a stationary gear of one of the impression and blanket cylinders. The second intermediate gear is swingable while meshingly moving along the first intermediate gear for rotating the gear of the impression or blanket cylinder. During movement of the second intermediate gear, it is always held between the first intermediate gear and the stationary gear.

14 Claims, 3 Drawing Sheets

IMAGE POSITION ADJUSTING DEVICE IN PRINTING MACHINE

BACKGROUND OF THE INVENTION

The present invention relates to an image position adjusting device in a printing machine. More particularly, the invention relates to the image position adjusting device for adjusting longitudinal image position relative to a printing sheet in an offset printing machine which is provided with a plate cylinder, a blanket cylinder, an impression cylinder and a sheet feed cylinder, and the adjusting device is capable of adjusting the longitudinal image position during operation of the offset printing machine.

U.S. Pat. No. 2,301,379 discloses an indexing apparatus for adjusting embossing or mortar line positions with respect to siding units such as those used in building walls by using an impression cylinder and an opponent roll. Even though the technical field is beyond the field of this invention, the technique described in this U.S. patent appears to be one of the prior art of the present invention.

According to the U.S. patent, as shown in FIG. 1, an impression cylinder 101 and a lower cylinder 102 are confronted with each other so as to nippingly interpose a siding 103. The cylinders 101 and 102 are connected to shafts 104 and 105, respectively. Further, a gear 113 is connected to the shaft 104 and another gear 114 is connected to the shaft 105. Each of the shafts 104 and 105 has one end rotatably supporting one end of each arms 106, 107, respectively. Another end of the arm 106 rotatably supports a first intermediate gear 108, and another end of the arm 107 rotatably supports a second intermediate gear 109. These intermediate gears 108 and 109 are meshedly engaged with each other. Further, the first intermediate gear 108 is in meshing engagement with the gear 113, and the second intermediate gear 109 is in meshing engagement with the gear 114 for drivingly connecting the cylinders 101 and 102.

The intermediate gears 108,109 are interposedly and rotatably supported by links 110 and 111. The link 110 is rotatably supported to a slider 112 which is slidable in a direction parallel to a line connecting central axes of the cylinders 101,102. By sliding the slider 112, relations of the gears 108,109 to the gears 113,114 is varied, whereby the angular rotational position of the impression cylinder 101 is adjusted so that any misalignment of the impressions relative to the length of the siding 103 is corrected.

If such structure is applied to an offset printing machine for adjusting the longitudinal imaging position in the printing sheet, the longitudinal position is controllable in a wide scale, that is, the output image can be largely displaced in the longitudinal direction by the sliding motion of the slider 112. However, to the contrary, fine control to the imaging position may be difficult to achieve. Further, disadvantageous rattling or looseness may occur at the gear trains having at least four gears in power transmission. Furthermore, it would be rather difficult to maintain the intermediate gears 108 and 109 at their predetermined controlled positions. Therefore, irregular rotations may occur between the impression cylinder 101 and the opponent cylinder 102. Moreover, the entire structure is rather complicated and requires a large number of mechanical components for assembly. Accordingly, the resultant device becomes costly.

SUMMARY OF THE INVENTION

It is, therefore, an object of the present invention to overcome the above-described drawbacks and to provide an improved image position adjusting device in a printing machine.

Another object of the invention is to provide such device capable of facilitating a fine and accurate imaging position control in a longitudinal direction of a printing sheet.

Still another object of the invention is to provide the adjusting device at a low cost and having a simple configuration while avoiding rotational irregularities between an impression cylinder and a blanket cylinder.

These and other objects of this invention will be attained by providing an image position adjusting device for controlling an imaging position in a longitudinal direction of a sheet in a printing machine. The printing machine includes side frames, a plate cylinder, a blanket cylinder, an impression cylinder, a sheet feed cylinder, and a gear trasmission for synchronously rotating the plate cylinder and the blanket cylinder. The image position adjusting device comprises a first intermediate gear rotatably supported to the side frames; a second intermediate gear in meshing engagement with the first intermediate gear, the second intermediate gear being drivingly engaged with one of the impression cylinder and the blanket cylinder; a shaft extending between the side frames for mounting the first intermediate gear, means for pivotally moving the second intermediate gear, the second intermediate gear being meshedly moved along the first intermediate gear in response to the pivotal movement of the moving means for rotating one of the impression and blanket cylinders with respect to the remaining one of the blanket and impression cylinder; and means for driving the moving means, the driving means being connected between the side frame and the moving means.

DETAILED DESCRIPTION OF THE PREFERRED EMBODIMENTS

Figure 2:
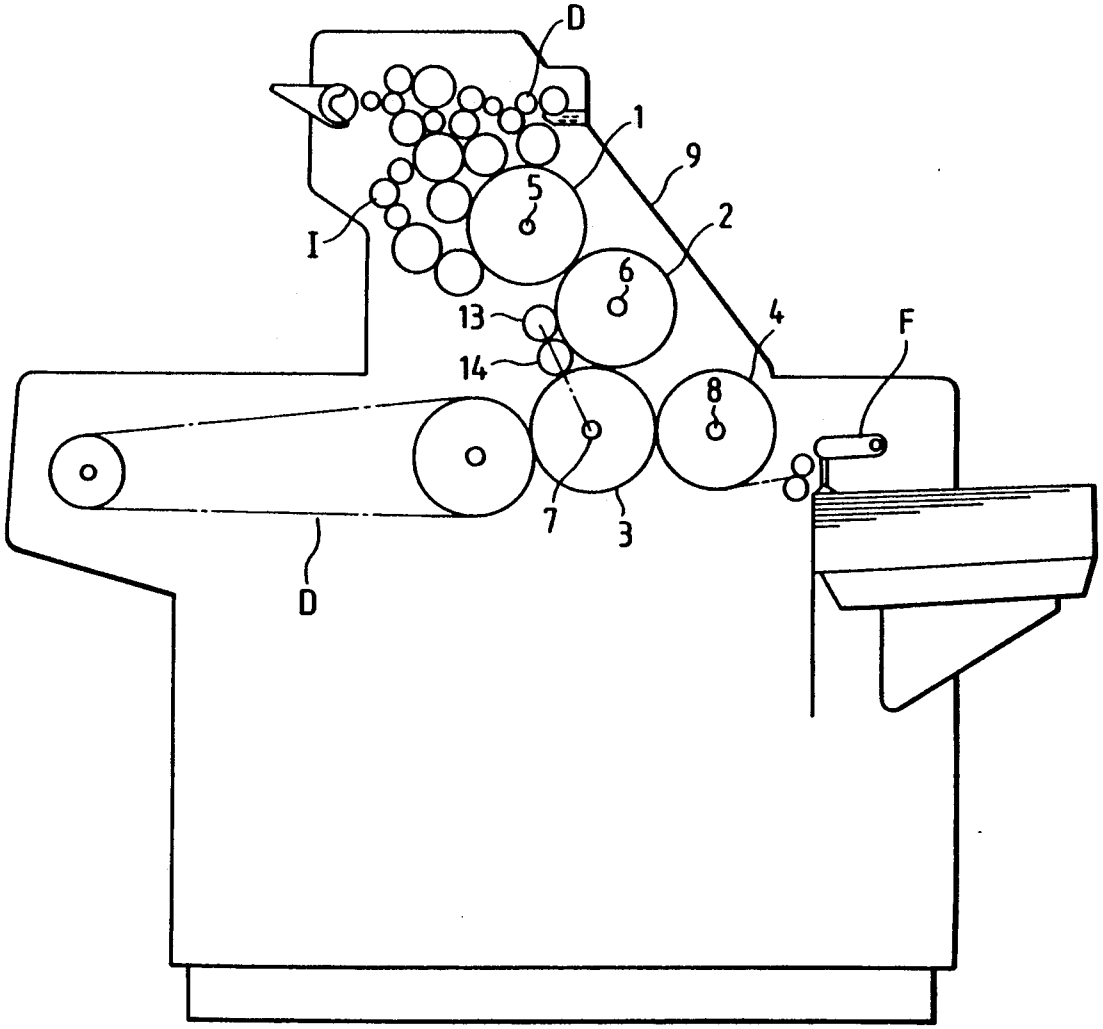
FIG. 2 is a schematic side view showing a printing machine incorporating an image position adjusting device.
Figure 1:
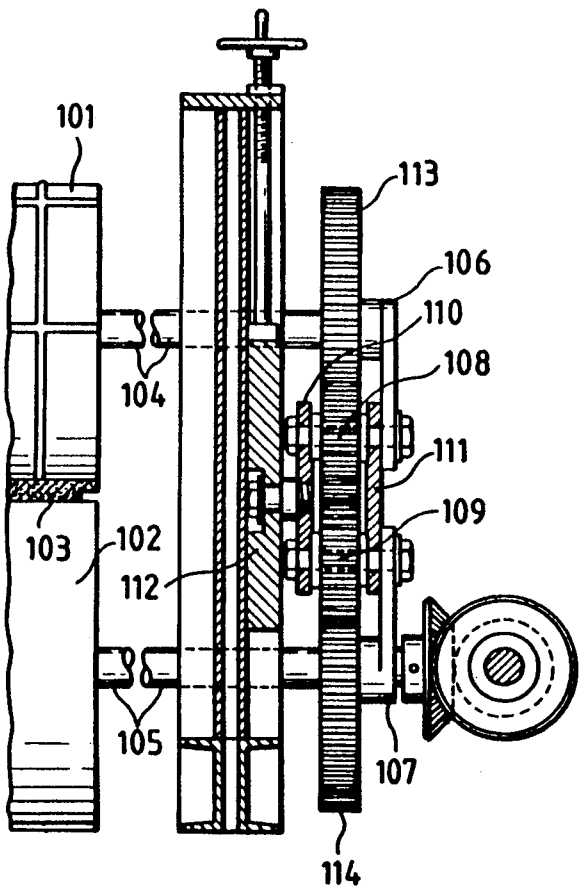
FIG. 1 PRIOR ART
FIG. 1 is a plan view partially cross-sectioned showing a conventional indexing apparatus.

First, a general structure of an offset printing machine will be briefly described with reference to FIG. 2. The offset printing press includes side frames 9 and 10 (see FIG. 4) for rotatably supporting a plate cylinder 1, a blanket cylinder 2, an impression cylinder 3 and a sheet feed cylinder 4. These cylinders have shafts 5, 6, 7 and 8 for their respective rotations. A sheet feed mechanism F is provided for feeding a printing sheet to the sheet feed cylinder 4, and sheet discharge mechanism D is provided for discharging an image carrying sheet. The plate cylinder 1 is in contact with a dampening roller system D and an inking roller system I. The plate cylinder 1 and the blanket cylinder 2 are drivingly connected for synchronous rotation. The printing sheet is delivered to the sheet feed cylinder 4 by the sheet feed mechanism F, and the sheet passes through a space defined between the blanket cylinder 2 and the impression cylinder 3, so that inking image on the blanket cylinder 2 are transferred onto the sheet. The thus printed sheet is delivered to the discharge mechanism D.

A first embodiment of this invention will be described with reference to FIGS. 2 thru 4.

The shaft 5 of the plate cylinder 1 secures a gear 11 confronting one of the frames 10, and the shaft 6 of the blanket cylinder 2 secures a gear 12 confronting the frame 10. The plate cylinder 1 is drivingly connected to the blanket cylinder 2 by means of these gears 11 and 12 meshedly engaged with each other, so that the cylinders 1 and 2 are rotated in synchronism with each other.

On the other hand, the blanket cylinder 2 and the impression cylinder 3 are drivingly connected to each other through first and second intermediate gears 13 and 14. More specifically, the shaft 6 of the blanket cylinder 2 also secures a gear 15 confronting the other side frame 9, and the shaft 7 of the impression cylinder 3 secures a gear 16 confronting the side frame 9. The first intermediate gear 13 is in meshing engagement with the gear 15, while the second intermediate gear 14 is in meshing engagement with the gear 16, and the intermediate gears 13 and 14 are meshedly engaged with each other. Therefore, the impression cylinder 3 is synchronously rotated with the rotation of the blanket cylinder 2. For the print position adjustment in longitudinal direction of a printing sheet, angular rotation of the impression cylinder 3 is controlled relative to the blanket cylinder 2. For example, in FIG. 3, if the impression cylinder 3 is rotated in a direction indicated by an arrow d, the output image on the printing sheet is displaced toward a tail edge portion of the sheet. On the other hand, if the impression cylinder 3 is rotated in a direction opposite the arrow d, the output image is displaced toward a leading edge portion of the sheet.

In the first embodiment, a rotation axis of the second intermediate gear 14 is positioned on a line A connecting between a rotation axis of the first intermediate gear 13 and a rotation axis of the impression cylinder 3 when a dial knob 22 (described later) is at its reference position, and the position of the second intermediate gear 14 is changeable for adjustment of the image position.

Figure 4:
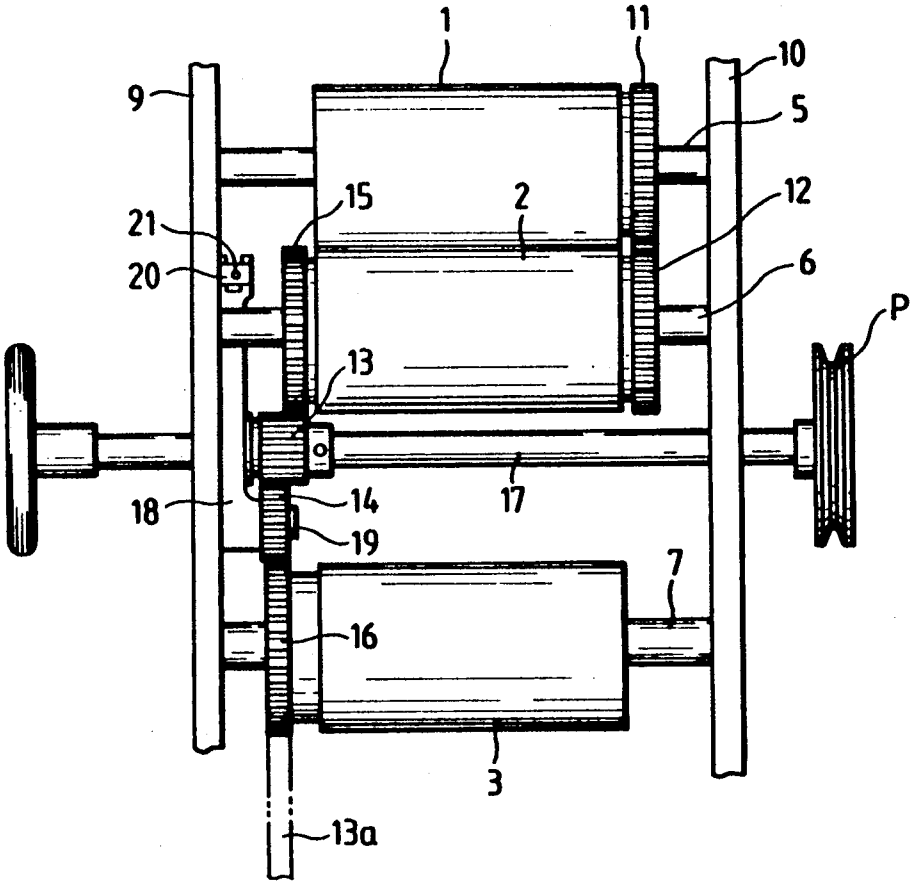
FIG. 4 is an exploded plan view showing the image position adjusting device according to the first embodiment of this invention.

The shaft 17 extends between the side frames 9 and 10 as best shown in FIG. 4, and the first intermediate gear 13 is mounted on the shaft 17. Therefore, the first intermediate gear 13 is rotatable in a stationary position about an axis of the shaft 17. The shaft 17 has one end securing a pulley P which is connected to a main drive motor (not shown) of the printing machine by a power transmission belt (not shown). Therefore, when the shaft 17 is rotated about its axis by the power source, the blanket cylinder 2 and the impression cylinder 3 are rotated. Further, the plate cylinder is also rotated by the gear train 12 and 11.

Figure 3:
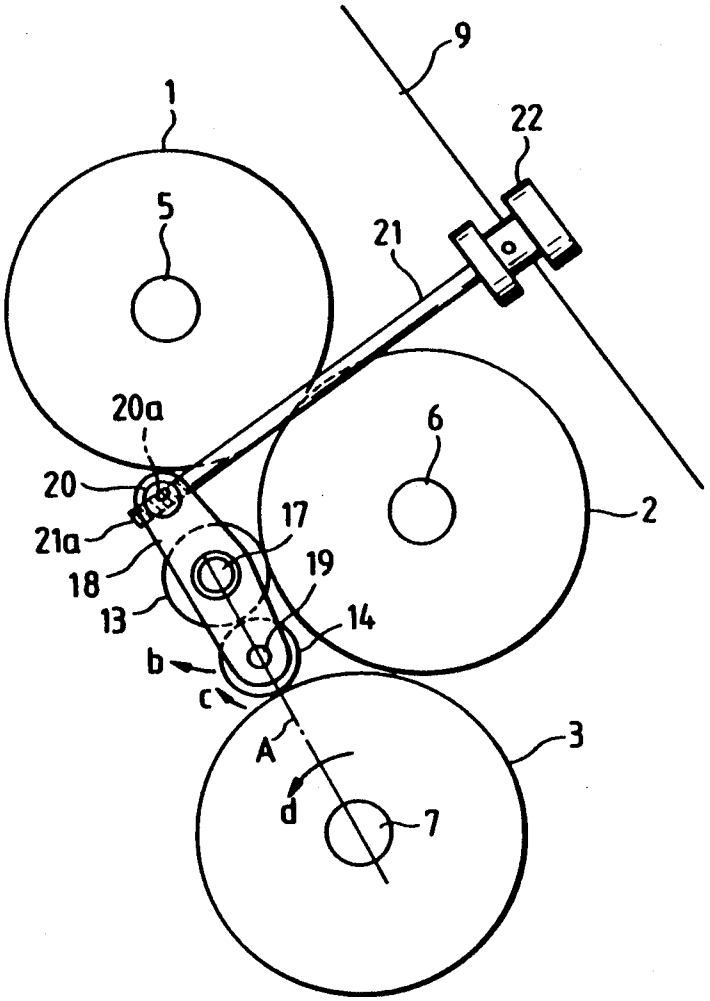
FIG. 3 is a schematic side elevational view showing an image position adjusting device according to a first embodiment of this invention.

Further, as best shown in FIG. 3, an intermediate portion of an arm 18 is pivotally supported to the shaft 17. The arm 18 has one end portion integrally provided with a short shaft 19 which extends inwardly (toward the side frame 10), and the second intermediate gear 14 is provided rotatable about the short shaft 19.

The arm 18 has another end portion loosely provided with a pin 20. The pin 20 is rotatable about its axis relative to the arm 18. Further, a female thread 20*a* is formed in the pin 20. The female thread hole extends in a direction perpendicular to the axial direction of the pin 20.

A rod 21 is provided rotatable about its axis. The rod extends in a given direction, and has one end connected to a dial knob 22 which projects out of the frame 9 for manipulation. The rod 21 has another end portion formed with the male thread 21*a* threadingly engageable with the female thread 20*a*. Therefore, the rod 21 is rotatably supported to the side frame 9 through the dial knob 22 and the arm 18. In other words, the arm 18 is not freely pivotable.

Upon rotation of the dial knob 22, the rod 21 is rotated about its axis and the arm 18 is pivoted about the shaft 17 because of the threading engagement between the threads 20*a* and 21*a*. In this case, since the pin 20 is rotatably supported to the other end portion of the arm 18, an angle defined by the rod 21 and the arm 18 is changed in response to the threading advancing or retracting amount given by the threads 20*a* and 21*a*.

Thus, in FIG. 3, when the arm 18 is pivoted in a direction indicated by an arrow b, in response to the rotation of the dial knob 22, the second intermediate gear 14 is also moved by the pivoting amount. In this case, the position of the first intermediate gear 13 is fixed, since the intermediate gear 13 is mounted on the shaft 17 extending between the frames 9 and 10. Therefore, by the pivotal movement of the arm 18 in the direction b, the second intermediate gear 14 is rotated in a direction indicated by an arrow c while the gear 14 is moved along the stationary gear 13. Therefore, the gear 16 engaged with the second intermediate gear 14 is rotated in a direction indicated by an arrow d. Accordingly, the impression cylinder 3 is rotated in the direction d while the blanket cylinder 2 is not rotated, so that the imaging position in the printing sheet can be displaced toward the tail edge portion of the printing sheet.

On the other hand, when the dial knob 22 is rotated in a reverse direction, the arm 18 is pivoted about the shaft 17 in a direction opposite the arrow b, so that the second intermediate gear 14 is moved in a direction opposite the arrow b while rotating in a direction opposite the arrow c. Therefore, the impression cylinder 3 is rotated in a direction opposite the arrow d, so that the imaging position in the printing sheet can be displaced toward the leading edge portion thereof.

Figure 5:
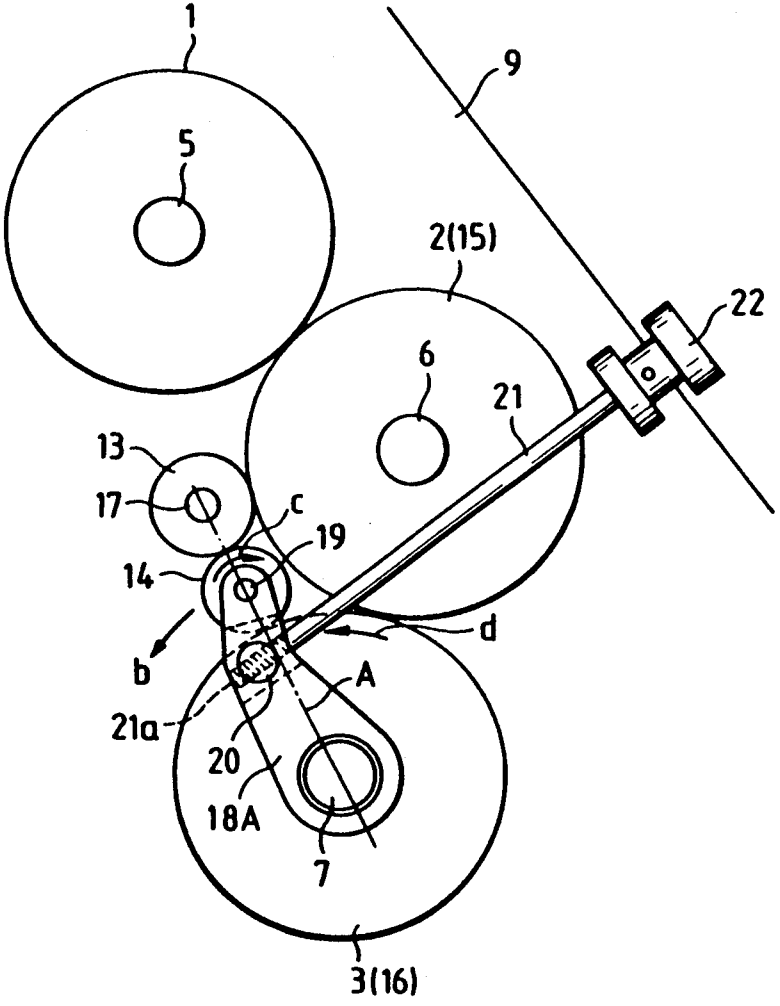
FIG. 5 is a schematic side elevational view showing an image position adjusting device according to a second embodiment of this invention.

A second embodiment according to this invention will next be described with reference to FIG. 5. In the second embodiment, an arm 18A has one end pivotally supported to the shaft 7 of the impression cylinder 3 and has another end provided with a short shaft 19 to which the second intermediate gear 14 is rotatably supported. Further, a pin 20 is loosely and rotatably supported at an intermediate portion of the arm 18A. Similar to the first embodiment, the pin 20 is formed with a female thread 20*a* threadingly engageable with a male thread 21*a* of a rod 21 which is rotatable by rotating a dial knob 22.

A rotation axis of the second intermediate gear 14 is positioned on a line A connecting between a stationary rotation axis of the first intermediate gear 13 and the rotation axis of the impression cylinder 3 when the dial knob 22 is at its reference position. Further, the arm 18A is pivotably moved about the shaft 7 by rotating the dial knob 22 while the second intermediate gear 14 is movingly engaged with the first intermediate gear 13 and the gear 16 (see FIG. 4) associated with the impression cylinder 3.

When the arm 18A is pivoted in a direction indicated by an arrow b upon rotation of the knob 22, the second intermediate gear 14 is rotated about the small shaft 19 in a direction indicated by an arrow c while moving along the stationarily fixed first intermediate gear 13, so that the gear 16 is rotated in a direction indicated by an arrow d for rotating the impression cylinder 3 in the direction d. Therefore, imaging position in the sheet is displaced toward the tail edge portion of the sheet. On the other hand, if the arm 18A is pivoted in the direction opposite the direction b, the imaging position in the sheet is displaced toward the leading edge portion of the sheet.

In the above described embodiments, the first intermediate gear 13 is driven by the main drive motor (not shown) of the printing machine so as to drive the blanket cylinder 2, the plate cylinder 1 and the impression cylinder 3. In other words, the first intermediate gear 13 functions as a drive gear for driving the plate and blanket cylinders as well as the impression cylinder. However, another driving system is available. For example, an independent drive gear maybe additionally provided, so that the independent gear is meshedly engaged with the gears 11 and 12 of the plate and blanket cylinders 1 and 2.

Figure 6:
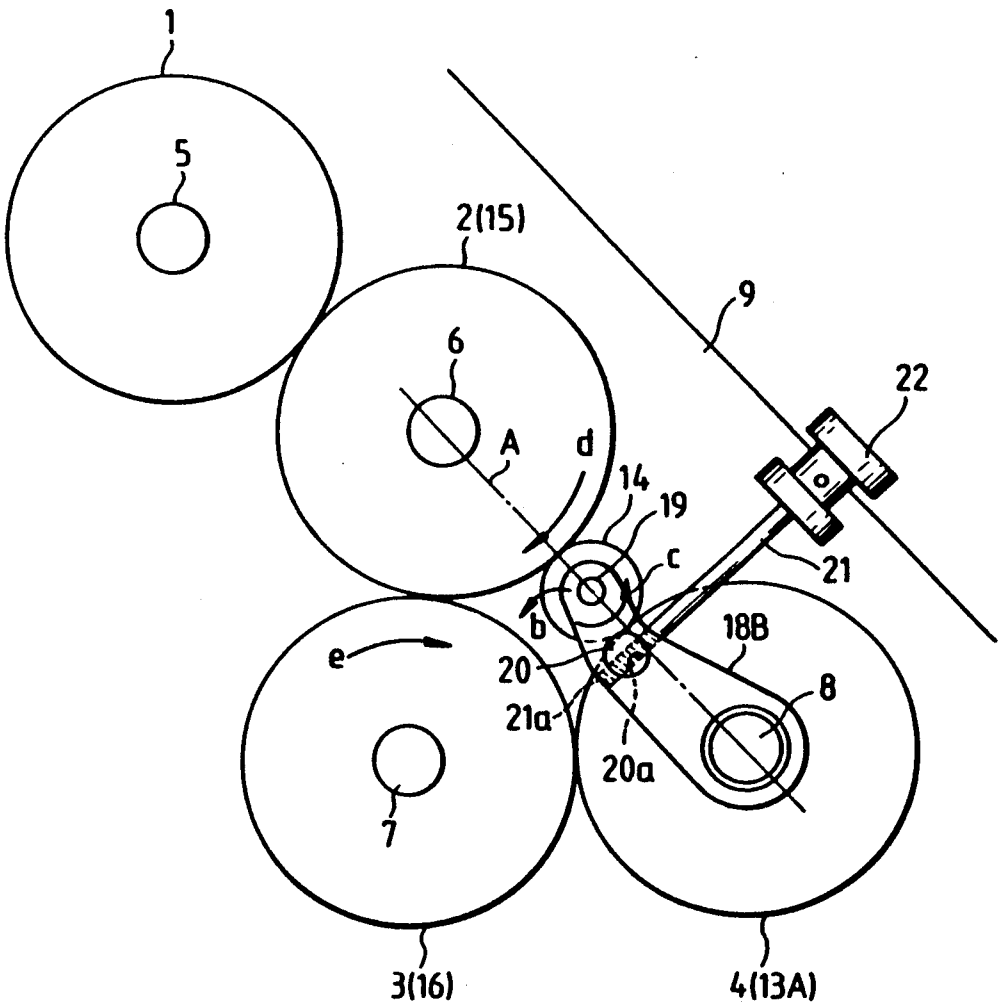
FIG. 6 is a schematic side elevational view showing an image position adjusting device according to a third embodiment of this invention.

A third embodiment according to this invention will be described with reference to FIG. 6. In the third embodiment, in order to adjust the longitudinal imaging position, the blanket cylinder 2 is rotated about its axis relative to the impression cylinder 3. Further, the shaft 8 of the sheet feed cylinder 4 has a gear 13A engageable with the gear 16 of the impression cylinder 3. Furthermore, the gear 13A of the sheet feed cylinder 4 serves as the first intermediate gear. The shaft 8 is connected to a power source (not shown).

In the third embodiment, a rotation axis of a second intermediate gear 14 is positioned on a line A connecting between a rotation axis of the shaft 6 of the blanket cylinder 2 and a rotation axis of the shaft 8 of the first intermediate gear 13A when a dial knob 22 is at its reference position.

An arm 18B has one end portion pivotally supported to the shaft 8 of the sheet feed cylinder 4, and the arm 18B has another end portion provided with a short shaft 19 to which the second intermediate gear 14 is rotatably supported. Further, similar to the foregoing embodiment, a pin 20 is rotatably supported to an intermediate portion of the arm 18B, and a female thread **20*a* is formed in the pin 20. The female thread 20*a* is threadingly engaged with a male thread 21*a* of a rod 21 which is provided with a dial knob 22**.

When the arm 18B is pivoted about the shaft 8 in a direction indicated by an arrow b, the second intermediate gear 14 is rotated in a direction indicated by an arrow c while the gear 14 is moved along the first intermediate gear 13A which is stationarily maintained. Therefore, the gear 15 engaged with the second intermediate gear 14 is rotated in a direction indicated by an arrow d about the shaft 6. Therefore, the blanket cylinder 2 is rotated in the direction d while the impression cylinder 3 is stationary. Rotating the blanket cylinder 2 in the direction d relative to the stationary impression cylinder 3 is equivalent to rotating the impression cylinder 3 in a direction e relative to the stationary blanket cylinder 2. Therefore, imaging position on the sheet is displaced toward the leading edge portion of the sheet. It is not deemed to be necessary to explain the case where the arm 18B is pivotally moved in a direction opposite the arrow b. In this case, the imaging position on the sheet is displaced toward the tail edge portion of the sheet.

In the third embodiment, a base end portion of the arm 18B can be pivotally supported on the shaft 6 of the blanket cylinder 2. In the latter case, the impression cylinder 3 is rotated relative to the blanket cylinder 2 because of the meshing engagement between the second intermediate gear 14 and the gear 15, between the gear 14 and the gear 13A and between the gear 13A and the gear 16. In this case, when the second intermediate gear 14 is rotationally moved along the gear 15, the gear 13A is rotated, so that the gear 16 is rotated for finally rotating the impression cylinder 3 relative to the blanket cylinder 2.

Further, in the foregoing embodiments, two intermediate gears 13 and 14 or 13A and 14 are provided. However, the number of intermediate gears is not limited to two.

As described above according to the present invention, the arm 18, 18A or 18B is pivotally moved about a specific axis (about the axis of the shaft 17, the axis of the shaft 7 or the axis of the shaft 8), and the second intermediate gear 14 is moved together with the arm, while the gear 14 is rotated about the short shaft 19. When the dial knob 22 is at its reference position, the rotation axis of the second intermediate shaft 14 is on the line A connecting between the rotation axis of the first intermediate gear and the rotation axis of the cylinder to which angular rotation control is contemplated. When the arm is pivotally moved, the second intermediate gear 14 is moved by the pivotal moving length of the arm, and is held at a position. Therefore, the imaging position control in longitudinal direction of the sheet is finely and accurately achievable.

Further, the first intermediate gear is always stabilizingly supported to the side frames through the shaft 17 or through the shaft 8, and the second intermediate gear is meshedly engaged with the first intermediate gear and the gear of the cylinder, such as the gear 16 of the impression cylinder 3 or the gear 15 of the blanket cylinder 2. Therefore, the second intermediate gear 14 can be stably moved between the stabilizedly supported gears, to thereby avoid disadvantageous play or looseness. Accordingly, no irregular rotation occurs between the impression and blanket cylinders, and precise rotation is obtainable for image position adjustment.

Furthermore, at least two intermediate gears and the arm are all that is required for the image position control. Therefore, the device can be provided at low cost with easy assembling work, and the resultant device can have high durability while elimilating mechanical breakdown.

While the invention has been described in detail and with reference to specific embodiments thereof, it would be apparent for those skilled in the art that various changes and modifications can be made therein without departing from the spirit and scope of the invention.

What is claimed is:

1. An image position adjusting device for controlling an imaging position in a longitudinal direction of a sheet in a printing machine, the printing machine including side frames (9, 10), a plate cylinder (1), a blanket cylinder (2), an impression cylinder (3), a sheet feed cylinder (4), and gear transmission means (11, 12) for synchronously rotating the plate cylinder (1) and the blanket cylinder (2), the image position adjusting device comprising:

a first intermediate gear (13 13A) rotatably supported to the side frames (9, 10);

a second intermediate gear (14) in meshing engagement with the first intermediate gear (13 13A), the second intermediate gear (14) being drivingly engaged with a gear (15, 16) which is coaxial with and rotatable together with one of the impression cylinder (3) and the blanket cylinder (2);

a supporting shaft (17, 8) extending between the side frames (9, 10) for mounting the first intermediate gear (13 13A) such that said first intermediate gear (13 13A) is rotatable in a stationary position about an axis of said supporting shaft (17, 8);

means (18 18A 18B) for pivotally moving the second intermediate gear (14), the second intermediate gear (14) being meshedly moved along the first intermediate gear (13 13A) in response to the pivotal movement of the moving means for rotating said gear (15 16) and said one of the impression and blanket cylinders in an amount which is different than an amount of rotation occurring during the same time period of the remaining one of the blanket and impression cylinders; and means (20 20*a* 21 21*a* 22) for driving the moving means, the driving means being connected between one of the side frames (9, 10) and the moving means;

wherein the second intermediate gear has a rotation axis which is positioned on a line connecting between a rotation axis of the first intermediate gear and a rotation axis of said one of the impression cylinder and the blanket cylinder when the driving means is at a reference position, wherein none of said second intermediate gear, said first intermediate gear and said one of said impression cylinder and blanket cylinder through which said line is connected have the same rotational axis.

2. The image position adjusting device as claimed in claim 1, further comprising;

a first gear (15) provided coaxial with the blanket cylinder (2) and rotatable together with the blanket cylinder; and a second gear (16) provided coaxial with the impression cylinder (3) and rotatable together with the impression cylinder, and wherein the first intermediate gear (13) is engaged with the first gear 15, and the seocnd intermediate gear (14) is engaged with the second gear (16).

3. The image position adjusting device as claimed in claim 2, wherein the moving means comprises:

an arm (18) having an intermediate portion pivotally supported to the supporting shaft (17) and having one end rotatably supporting the second intermediate gear (14), and having another end connected to the driving means.

4. The image position adjusting device as claimed in claim 2, wherein the moving means comprises:

an arm (18A) having one end pivotally supported, another end rotatably supporting the second intermediate gear (14), and an intermediate portion connected to the driving means.

5. The image position adjusting device as claimed in claim 3, wherein the driving means comprises:

a pin (20) rotatably supported to the arm (18), the pin being formed with a female thread (20*a*);

a rod (21) having one end formed with a male thread (21*a*) and having another end; and, a dial knob (22) coupled to the other end of the rod (21), the dial knob being supported to the side frame (9), the pin (20) being positioned at the other end of the arm (18).

6. The image position adjusting device as claimed in claim 5, wherein the driving means comprises:

a pin (20) rotatably supported to the arm (18A), the pin being formed with a female thread (20*a*);

a rod (21) having one end formed with a male thread (21*a*) and having another end; and, a dial knob (22) coupled to the other end of the rod (21), the dial knob being supported to the side frame (9), the pin (20) being positioned at the intermediate portion of the arm (18A).

7. The image position adjusting device as claimed in claim 5, wherein the second intermediate gear is positioned on the line connecting between the rotation axis of the first intermediate gear (13) and the rotation axis of the impression cylinder (3) when the dial knob is at a reference position corresponding to said reference position of said driving means, and wherein the rotation axis of the first intermediate gear is identical with an axis about which the arm (18) is pivoted.

8. The image position adjusting device as claimed in claim 6, wherein the second intermediate gear is positioned on the line connecting between the rotation axis of the first intermediate gear and the rotation axis of the impression cylinder when the dial know is at a reference position corresponding to said reference position of said driving means, and wherein the one end of the arm (18A) is pivotally supported to a shaft of the impression cylinder.

9. The image position adjusting device as claimed in claim 1, further comprising:

a first gear (15) provided coaxial with the blanket cylinder (2) and rotatable together with the blanket cylinder; and a second gear (16) provided coaxial with the impression cylinder (3) and rotatable together with the impression cylinder;

said first intermediate gear (13A) provided coaxial with the sheet-feed cylinder (4) and rotatable together with the sheet feed cylinder, the first intermediate gear (13A) being engageable with the second gear (16), and the first intermediate gear (13A) being also engageable with the second intermediate gear (14).

10. The image position adjusting device as claimed in claim 9, wherein the second intermediate gear has a rotation axis positioned on a line connecting between a rotation axis of the first intermediate gear (13A) and a rotation axis of the blanket cylinder when the driving means is at said reference position.

11. The image position adjusting device as claimed in claim 10, wherein the moving means comprises:

an arm (18B) having one end pivotally supported, another end rotatably supporting the second intermediate roller (14), and an intermediate portion connected to the driving means.

12. The image position adjusting device as claimed in claim 11, wherein the supporting shaft comprises a shaft of the sheet feed cylinder, and wherein the one end of the arm (18B) is pivotally supported to the shaft of the sheet feed cylinder.

13. The image position adjusting device as claimed in claim 1, wherein the amount of rotation of said gear (15, 16) and said one of said impression and blanket cylinders is greater than the amount of rotation occurring during the same time period of the remaining one of the blanket and impression cylinders.

14. The image position adjusting device as claimed in claim 13, wherein the remaining one of the blanket and impression cylinders does not rotate during said same time period.

* * * * *